US005368245A

United States Patent [19]

Fore

[11] Patent Number: 5,368,245

[45] Date of Patent: Nov. 29, 1994

[54] TWO-PIECE PAY-OUT TUBE

[75] Inventor: James R. Fore, Siler City, N.C.

[73] Assignee: Communication Cable, Inc., Sanford, N.C.

[21] Appl. No.: 93,654

[22] Filed: Jul. 20, 1993

[51] Int. Cl.[5] ..... B65H 57/12; B65H 57/18

[52] U.S. Cl. ..... 242/157 R; 242/163; 242/171

[58] Field of Search ..... 242/163, 171, 172, 157 R, 242/137.1, 129.7

[56] References Cited

U.S. PATENT DOCUMENTS

| | | | |
|---|---|---|---|
| 4,009,845 | 3/1977 | Santucci et al. | 242/137.1 X |
| 4,019,636 | 4/1977 | Wise | 242/171 X |
| 4,050,648 | 9/1977 | Tisma | 242/137.1 X |
| 4,149,479 | 2/1979 | Dennison | 242/137.1 X |
| 4,274,607 | 6/1981 | Priest | 242/163 |
| 4,832,269 | 5/1989 | Carroll et al. | 242/172 X |

*Primary Examiner*—Stanley N. Gilreath
*Assistant Examiner*—John Q. Nguyen
*Attorney, Agent, or Firm*—Rhodes, Coats & Bennett

[57] ABSTRACT

A two-piece pay-out tube is secured through an outlet opening of a cable box such that cable being fed from the box can be threaded through the assembled pay-out tube. One piece of the pay-out tube includes an elongated tube having an inner flange. This tube is designed to be inserted into the opening within the cable box from inside the box such that the inner flange abuts against the inside wall of the cable box. A second piece, referred to as a locking collar, is designed to be snapped into engagement with the inner flange from outside of the box. In particular, the locking collar includes a plurality of locking tabs that project from the outside of the box, through the opening within the box, and into engagement with the inner flange resulting in a locking relationship between the inner flange and its associated elongated tube and the locking collar.

17 Claims, 3 Drawing Sheets

TWO-PIECE PAY-OUT TUBE

FIELD OF INVENTION

The present invention relates to pay-out tubes used in conjunction with cable boxes and containers for facilitating the feeding of cable, wire, etc., from such boxes containers.

BACKGROUND OF THE INVENTION

It has been known to wind cable in a figure eight pattern in such a fashion that results in a radial opening being formed through the wall of the cable winding once the winding has been completely formed. Because of the particular figure eight winding procedure, the end of the cable disposed interiorly of the winding can be directed from inside of the winding through the radial opening formed in the winding without the cable becoming twisted and difficult to handle.

Typically, such figure eight windings are housed and transported within a cardboard container having an opening formed in one wall of the container. As pointed out above, in removing cable from the cardboard box, the inner end of the cable is directed outwardly through the radial opening and through the opening within the wall of the cardboard container.

To facilitate the feeding of cable from such a cardboard container, it is preferable to mount what is referred to as a pay-out tube within the opening of the cardboard container wall. In particular, the pay-out tube is usually inserted into the formed radial opening within the winding itself. This prevents the formed radial opening from collapsing during transport or the unwinding process. Besides being inserted into the formed radial opening within the winding, the pay-out tube is also coupled to the outlet opening formed in the cardboard container wall structure. Thus, the inside terminal end of the cable can be threaded through the pay-out tube inserted within the radial opening and out an outlet end of the pay-out tube that is disposed about the outlet opening formed in the cardboard container.

As noted above, pay-out tubes are known and are used extensively in the cable industry. For a basic understanding of the state-of-the art with respect to pay-out tubes one is referred to the following U.S. Patents: U.S. Pat. Nos. 4,022,399; 4,057,203; 4,274,607; 5,042,739; 5,064,136; 5,150 852; 5,115,995; 5,152,476; and 4,373,687.

There are drawbacks and disadvantages with known pay-out tube designs. First, many pay-out tubes by virtue of their design, are difficult to install and are particularly difficult to couple to the outlet opening of the cardboard box. Moreover, conventional pay-out tubes are not designed to retain and hold the terminal end of the cable extending through the pay-out tube and from the cable box. Essentially, with prior art pay-out tube designs, the exterior terminal end of the cable simply dangles free and is not at all controlled. It is not unusual for the exterior terminal end of the cable to be inadvertently pulled back within the cable box and this results in the end user having to locate the inner terminal end and to thread the same back through the pay-out tube before the cable can be unwound and used.

Therefore, there is and continues to be a need for a cable container pay-out tube that is easy to install and particularly easy to attach or couple to the outlet opening of the cable box.

SUMMARY AND OBJECTS OF THE INVENTION

The present invention entails a two-piece pay-out tube that is designed to overcome the drawbacks and disadvantages of pay-out tube designs of the prior art. In particular, the pay-out tube of the present invention is designed such that it is simple in design but easy to install within a cable container and which can easily be mounted or coupled to the outlet opening formed in a wall of the cable container.

Structurally, the pay-out tube of the present invention entails a first piece in the form of an elongated tube that is designed to be mounted interiorly of the cable container. The elongated tube is designed to be inserted within the radial opening formed in the cable winding and to project therefrom to where an outlet end extends adjacent and through the outlet opening within the container wall. An inner flange is formed on the outlet end of the elongated tube and abuts against the inside of the container wall having the outlet opening therein. To secure the elongated tube within the outlet opening of the cable container, there is provided a second piece in the form of a snap-on locking collar that is secured to the elongated tube from the outside of the container box. The separate locking collar includes a central opening for fitting onto the elongated tube extending through the opening of the container box. In addition, the locking collar includes an outer flange that abuts against the outside of the container wall having the outlet opening therein. A pair of locking tabs project from the outer flange through the opening within the container and lock within locking openings formed within the inner flange, thereby securing the locking collar to the elongated tube and effectively sandwiching the container wall between the locking collar and the inner flange of the elongated tube. In addition, the outer flange of the locking collar includes a cable clip for receiving and retaining a remote end of the cable extending through the pay-out tube and disposed exteriorly of the cable container or box.

It is therefore an object of the present invention to provide a pay-out tube design that is easy to install but which is relatively simple in design.

Another object of the present invention resides in the provision of a two-piece pay-out tube that is designed to be snap secured together so as to effectively sandwich the container wall between the two pieces that form the assembled pay-out tube.

Another object of the present invention resides in the provision of a pay-out tube that is provided with means for securing the terminal end of the cable extending from the container to an area outside of the container such that the cable end is not free to move about and therefore is securely held outside of the container in such a fashion that the same cannot be inadvertently drawn inside of the container.

Another object of the present invention resides in the provision of a two-piece pay-out tube that can be efficiently formed of molded plastic.

Still a further object of the present invention resides in the provision of a two-piece pay-out tube that can be easily attached about the opening formed within the sidewall of the cable container in such a fashion that the assembled pay-out tube is firmly secured and held in place about the outlet opening of the cable container.

Other objects and advantages of the present invention will become apparent and obvious from a study of the following description and the accompanying drawings which are merely illustrative of such invention.

DETAILED DESCRIPTION OF THE INVENTION

Figure 3:
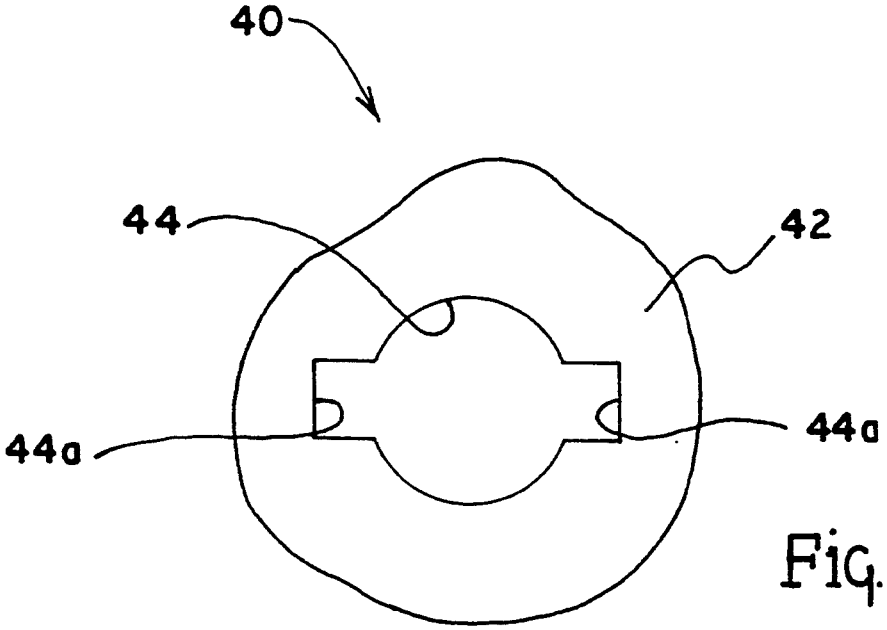
FIG. 3 is a fragmentary elevational view of a portion of the cable container box having the outlet opening therein.
Figure 4:
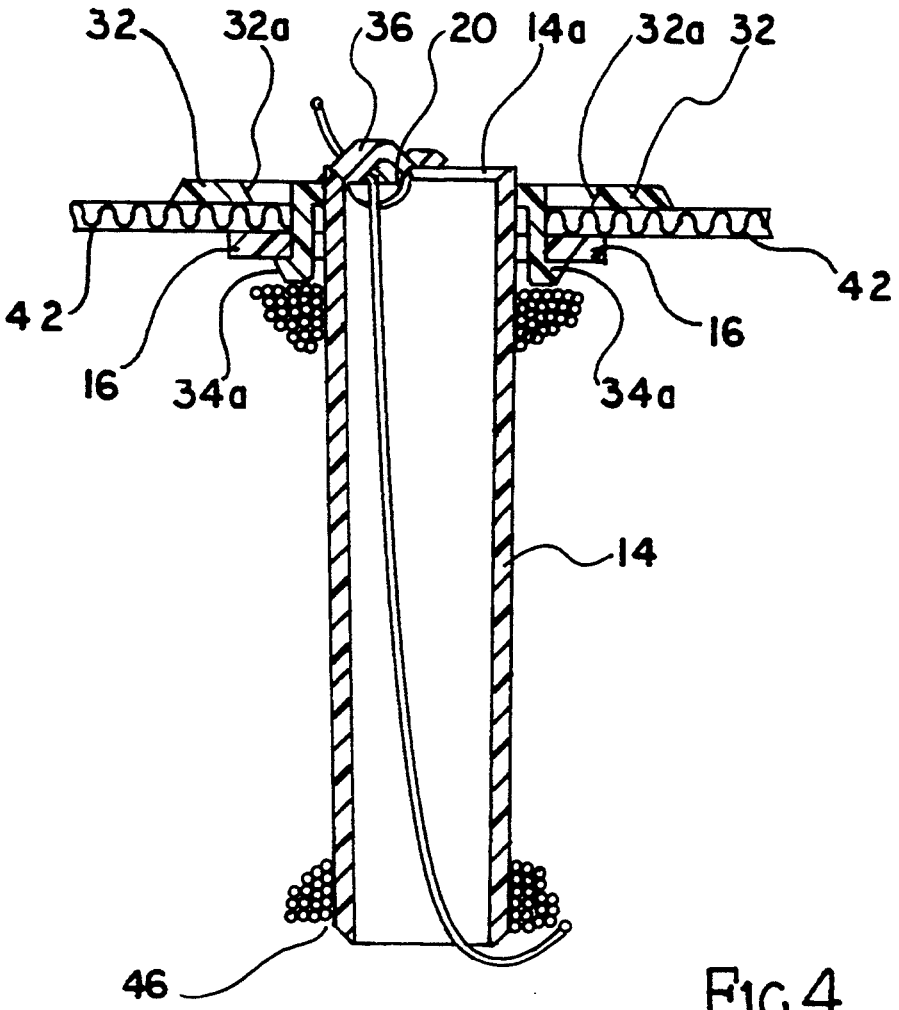
FIG. 4 is a fragmentary cross-sectional view showing the two-piece pay-out tube assembled about the outlet opening of a cable box or container.

With further reference to the drawings, the two-piece pay-out tube of the present invention is shown therein and indicated generally by the numeral 10. Pay-out tube 10 basically is of a two-piece construction and includes an interior tube indicated generally by the numeral 12 and an exterior locking collar or locking plate indicated generally by the numeral 14. By making reference to interior tube 12, "interior" refers to the fact that tube 12 is designed to be inserted into the outlet opening of the cable box from inside the box. Similarly, locking collar 14 is referred to as "exterior" locking collar 14 because the same is designed to snap together with the interior tube 12 from outside of the cable box which is shown in FIGS. 3 and 4 and indicated generally by the numeral 40.

Turning to a discussion of the interior elongated tube 12, it is seen that the same comprises an elongated tube 14 having an outlet end 14*a*, an inlet end 14*b* and an outlet extension 14*c*.

Secured adjacent the outlet end 14*a* is an inner flange 16. Provided within inner flange 16 is a pair of locking openings 18. Formed on the back side of inner flange 16, that is the side opposite the outlet end 14*a*, is a pair of latching surfaces 16*a* and 16*b*. As seen in the drawings, particularly FIG. 2, the latching surfaces 16*a* and 16*b* are each disposed just outwardly of the respective locking opening 18 formed in the inner flange 16.

To facilitate the turning of the cable and its exit from the cable container 40 and the pay-out tube 10, there is provided a turn cut-out 20 that is formed in the outlet end 14*a* of the elongated tube. It may be preferable to place such a cut-out 20 on opposites of the outlet end 14*a*.

Now, turning to a description of the locking collar 14, it is seen that the same comprises a central opening 30 having a diameter sufficiently large to enable the same to be inserted over the outlet extension 14*c* of elongated tube 14. Extending outwardly from the central opening 30 is an outer flange 32 that includes a pair of spaced apart openings 32*a* formed therein. Projecting from the inside face of the outer flange 32*a* is a pair of locking tabs 34. In a preferred embodiment the entire pay-out tube 10 is of a molded plastic design. Accordingly, locking tabs 34, which include a pair of ears 34*a*, are spring-biased towards an outer locking position.

Figure 1:
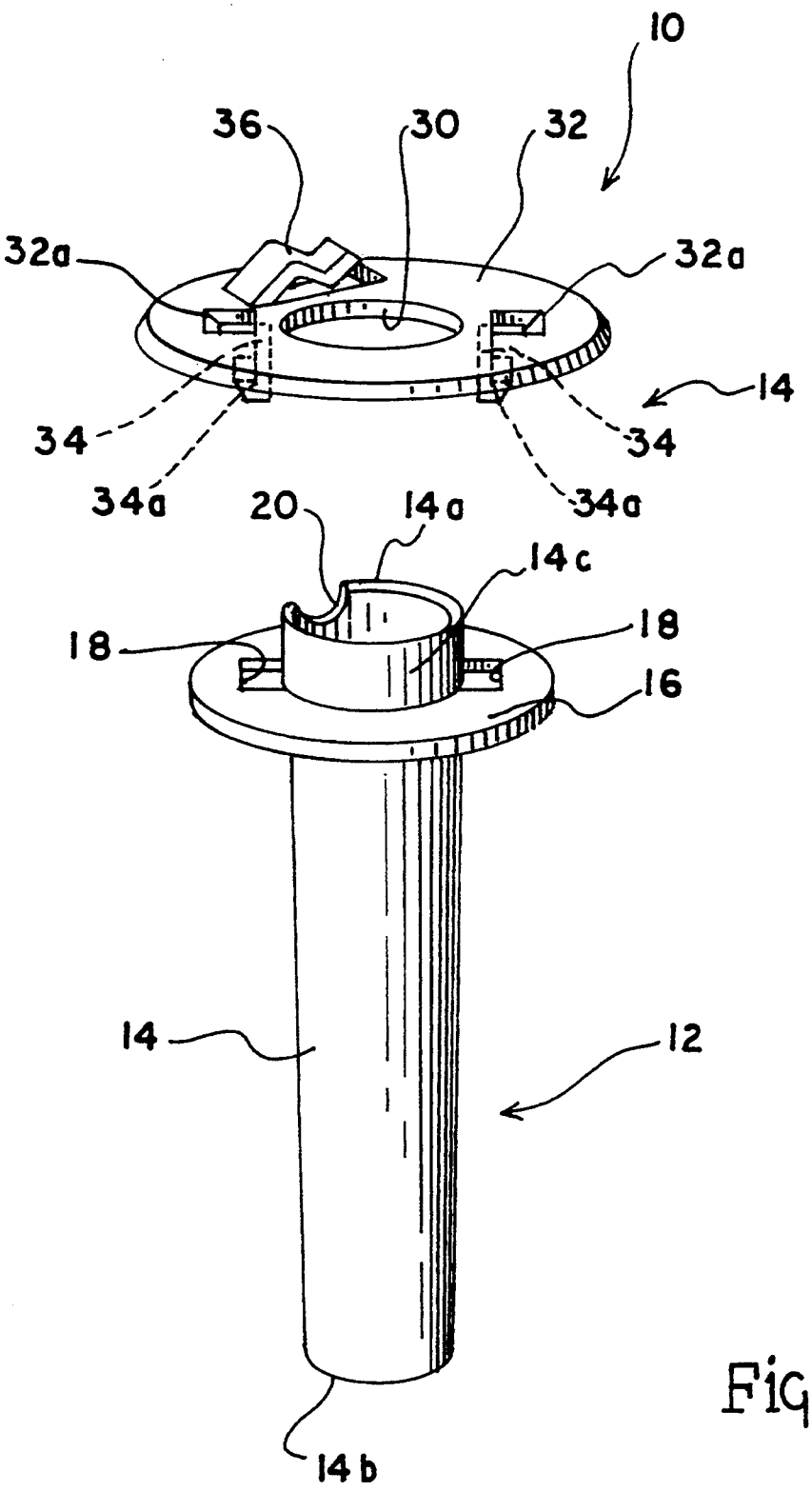
FIG. 1 is a perspective view of the two-piece pay-out tube of the present invention shown disassembled.
Figure 2:
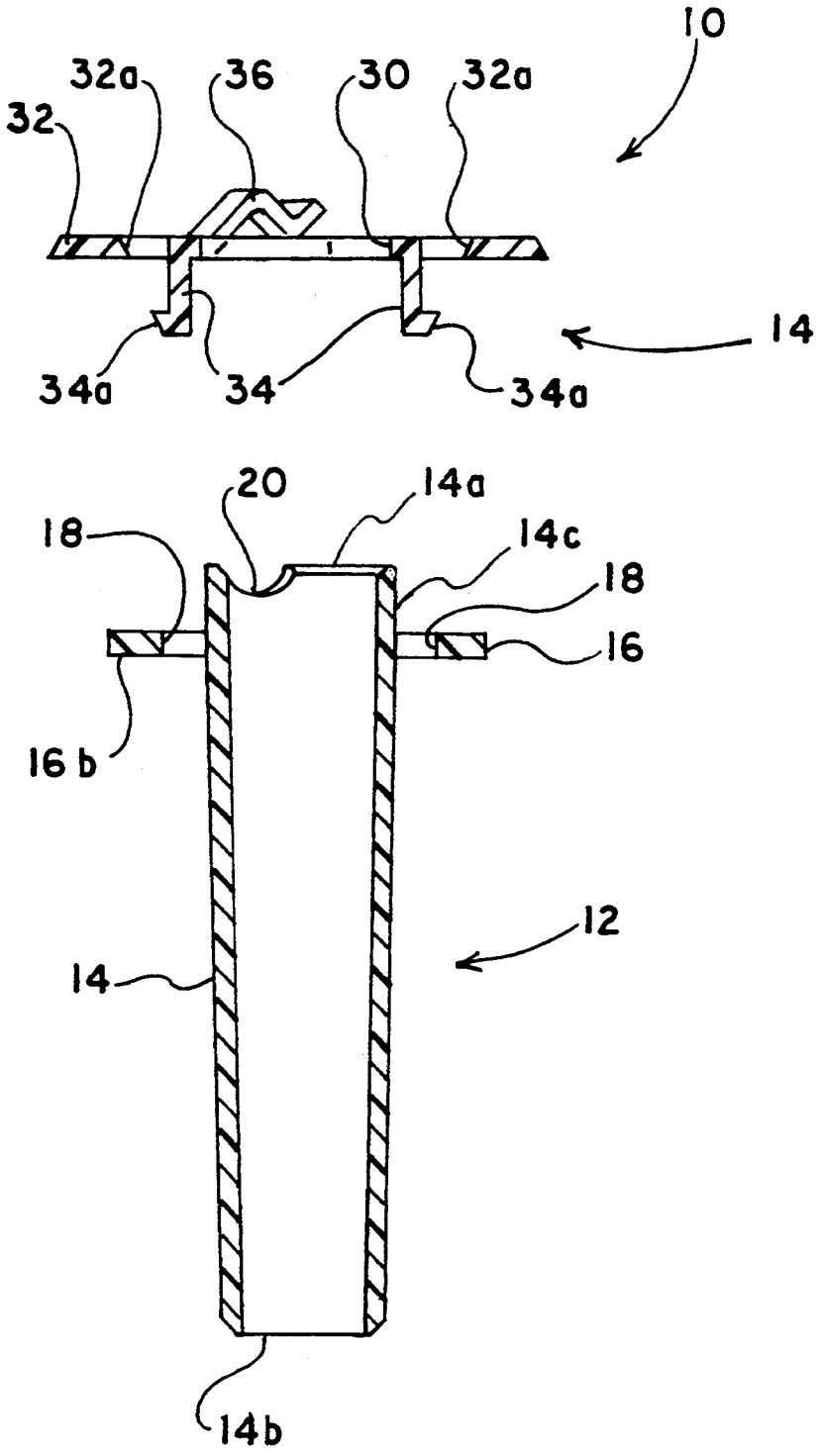
FIG. 2 is a vertical sectional view of the two-piece pay-out tube of the present invention shown disassembled.

To retain and hold the remote end of the cable extending from the container and the pay-out tube 10, there is provided a cable clip 36 formed on the outer face of the outer flange 32. Cable clip 36 in a preferred embodiment is integrally molded with the locking collar 14 and due to its construction and relationship to the flange is biased to assume a closed position as shown in FIGS. 1 and 2. However, the clip 36 can be pulled open and a cable can be slipped thereunder in such a fashion that the cable clip 36 will retain the terminal end of the cable against the outer face of the outer flange 32.

Before describing how the two-piece pay-out tube 10 is mounted and secured together, it will be beneficial to basically review the cable box and the environment in which the pay-out tube is employed. As already discussed, it is typical and conventional practice to place wound cable in a cardboard box that in the case of the present disclosure is indicated generally by the numeral 40. The cardboard box includes a wall 42 having a central or outlet opening 44 formed therein. Outlet opening 44 includes a generally central round opening that is expanded or extended to a key-like opening by the provision of a pair of opposed tab openings 44*a*. See FIG. 3. As already discussed, it is conventional practice for the cable to be formed into a winding by continuously wrapping the cable in a figure eight configuration. It is also conventional to retard and advance the figure eight winding process so as to form a radial opening 46 in the wound cable. This enables the innermost terminal end of the wound cable to be fed through the radial opening 46 and out the container 40 via the outlet opening 44. Consequently, when the cable housed within the cardboard box 40 is unwound it is done so through a process where the cable is unwound from the inside of the winding towards the outside. Expressed in another way, the cable winding is unwound by feeding the inner terminal end of the wound cable through the radial opening 46 and out the pay-out tube 10 which is mounted within the outlet opening 44 of a cardboard or other type of container 40.

To facilitate the movement of the cable from the interior of the winding out the cable box 40, the pay-out tub 10 is designed to be mounted within the outlet opening 44. In this regard, the individual packaging the completed winding, first inserts the elongated tube 14, inlet end first, into the radial opening 46 formed in the winding. Consequently, the inner flange 16 will abut against the outer portion of the cable winding. Next, the interior end of the cable located interiorly within the winding is threaded into the inlet end 14*b* of the elongated tube 14 and out the outlet end 14*a*. Thereafter, the interior terminal end is passed out the cable outlet opening 44 formed in the wall 42 of the cardboard box. During this process, the entire cable winding along with the secured pay-out tube 10 is transferred to the interior of the container box 40 and the pay-out tube 10 while being maintained within the radial opening 46 formed in the cable is positioned such that the outer extension 14*c* of the elongated tube 14 is projected out through the central outlet opening 44 of the box 40 and the inner flange 16 is abutted against the inside of the box or wall 42. This is particularly illustrated in FIG. 4.

Now, to secure the elongated tube 14 within the outlet opening 44 of the cable box, the exterior locking collar 14 is snapped, from the outside, into the locking openings 18 formed in the inner flange 16. In particular, the outlet extension 14c projects through the outlet opening 44 formed in the wall 42 of the cable box 40. To secure the locking collar 14 to the interior tube 12, the locking tabs 34 are directed through the tab extension openings 44a that form a part of the outlet opening 44 formed in the cable box 40. The two locking tabs 34 are projected through the locking opening 18 of the inner flange 16. Because the locking tabs 34 are at least somewhat resilient, it follows that the ears 34*a* are angled such that the locking tabs are urged inwardly as they engage the outside edges of the locking openings 18 as the locking collar 14 is pressed onto the outlet extension 14*c* of the elongated tube 14. Once the ears 34*a* clear the back side of the inner flange 16 it is appreciated that because they are biased towards an outer locked position that the ears 34*a* will spring outwardly and latch against the locking surfaces 16*a* and 16*b* of the inner flange 16. See FIG. 4. Therefore, it is appreciated that the locking collar 14 and the inner flange 16 effectively sandwich the wall 42 of the cable box. Once the locking collar 14 has been securely secured to the elongated tube 14 via the inner flange 16, then the terminal end of the cable that lies outside of the box 40 can then be secured by the cable clip 36. By securing the exterior terminal end cable with the cable clip 36 it follows that the cable cannot be inadvertently retracted back into the cable box 40.

The two-piece pay-out tube 10 of the present invention can be constructed of molded plastic or any other suitable material. As pointed out above, it has many advantages over prior art pay-out tubes inasmuch as the pay-out tube 10 of the present invention is easy to install within the cable box and includes the cable clip 36 for retaining the exterior terminal end of the cable outside of the cable box 40.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A two-piece pay-out tube adapted to fit through a key-like opening formed within a wall of a cable container through which cable from a winding disposed within the container is fed, comprising:

a) an elongated tube having an inlet end and an outlet end;

b) the outlet end of the elongated tube including an outer extension that in an assembled mode projects through the opening within the container wall;

c) an inner flange formed on the outlet end of the tube and extending radially outwardly therefrom and adapted to abut against the inside of the container wall adjacent the key-like opening therein;

d) a pair of spaced apart locking openings formed in the inner flange radially outwardly of the tube;

e) a locking plate adapted to be secured to the inner flange;

f) the locking plate having an opening formed therein for fitting around and resting on the outer extension of the tube and wherein the locking plate itself abuts against the outside of the container wall having the key-like opening therein; and g) a pair of spaced apart locking tabs integral with and projecting from the locking plate and in a secured mode extending through the key-like opening within the container wall and past the locking openings of the inner flange wherein the locking tabs latch against the locking openings formed in the inner flange and effectively sandwich the wail of the container between the inner flange and the locking plate and secure the locking plate to the inner flange and the elongated tube.

2. The two-piece pay-out tube of claim 1 wherein the locking plate includes an outer face when assembled with the tube and wherein there is provided a cable clip formed on the outer face of the locking plate for holding a terminal end portion of a cable extending from the pay-out tube.

3. The two-piece pay-out tube of claim 2 wherein the cable clip is integrally formed with the locking plate.

4. The two-piece pay-out tube of claim 2 wherein the cable clip is biased to assume a closed position but wherein the cable clip can be flexed outwardly away from the face the locking plate for inserting a cable between the cable clip and the outer face of the locking plate.

5. The two-piece pay-out tube of claim 4 wherein the two-piece pay-out tube is formed of molded plastic and wherein the entire locking plate including the locking tabs and the cable clip are integrally formed.

6. The two-piece pay-out tube of claim 1 wherein the outlet end of the elongated tube includes a terminal end having a cut-out formed therein wherein a cable passing from the outlet end of the tube may be turned and directed through the cut-out.

7. The two-piece pay-out tube of claim 6 wherein the cut-out is arcuately shaped.

8. The two-piece pay-out tube of claim 1 wherein inner flange and the locking plate are circular.

9. A two-piece pay-out tube adapted to fit through an opening formed within a wall of a cable container through which cable from a winding disposed within the container is fed, comprising:

a) an elongated tube having an inlet end and an outlet end;

b) the outlet end of the elongated tube including and outer extension that in an assembled mode projects through the opening within the container wall;

c) an inner flange formed on the outlet end of the tube and extending radially outwardly therefrom and adapted to abut against the inside of the container wall adjacent the opening therein;

d) a pair of locking openings formed in the inner flange on generally opposite sides of the tube with the locking openings being independent of and spaced radially outwardly from the tube;

e) locking plate adapted to be fastened directly to the inner flange; and f) a pair of spaced apart locking tabs projecting from she locking plate at a generally normal angle and spaced such that in a secured mode the locking tabs project outwardly of the tube and through the opening within the container wall and register with the locking openings formed in the inner flange so as to directly secure the locking plate to the inner flange independently of the tube.

10. The two-piece pay-out tube of claim 9 wherein the exteriorly applied locking plate includes a clip for holding and retaining the cable extending from the container.

11. The two-piece pay-out tube of claim 9 wherein the locking tabs projecting inwardly from the locking plate are biased to assume a locked position and wherein the same locking tabs can be flexed such that they can be moved into a locked relationship with the inner flange.

12. The two-piece pay-out tube of claim 9 wherein the outlet end of the elongated tube includes a terminal end having a cut-out formed therein wherein a cable passing from the outlet end of the tube may be turned and directed through the cut-out.

13. The two-piece pay-out tube of claim 12 wherein the cut-out is arcuately shaped.

14. A method of mounting a two-piece pay-out tube to a cable container comprising the steps of:

a) from the inside of the container, inserting an outlet end of an elongated tube through an opening formed in a wall of the container;

b) abutting an inner flange secured to the elongated tube against the inside of the wall and effectively limiting the outward movement of the tube;

c) from outside of the container, sliding an exterior locking collar onto a portion of the elongated tube extending through the opening of the wall and effectively sandwiching the wall of the container between the flange and the locking collar; and d) projecting a pair of spaced apart locking tabs the locking collar at a generally normal angle and through the opening within the wall of the container and into engagement with a pair of locking openings formed in the inner flange so as to directly couple the locking collar to the inner flange such that the locking tabs project outwardly of the elongated tube.

15. The method of claim 14 further the comprising the step of clamping a cable exiting from the cable container to a cable clip formed on the outer face of the locking collar.

16. The method of claim 14 further including the step rousing a cable passing from the outlet end of the tube through out formed in the outlet end of the elongated tube.

17. The method of claim 16 wherein the cut-out is arcuately shaped.

* * * * *